US010264383B1

(12) United States Patent
Johnson et al.

(10) Patent No.: US 10,264,383 B1
(45) Date of Patent: Apr. 16, 2019

(54) MULTI-LISTENER STEREO IMAGE ARRAY

(71) Applicant: Apple Inc., Cupertino, CA (US)

(72) Inventors: Martin E. Johnson, Los Gatos, CA (US); Justin D. Crosby, Cupertino, CA (US); Tom-Davy W. Saux, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/275,206

(22) Filed: Sep. 23, 2016

Related U.S. Application Data

(60) Provisional application No. 62/232,819, filed on Sep. 25, 2015.

(51) Int. Cl.

| | |
|---|---|
| ***H04R 5/02*** | (2006.01) |
| ***H04S 7/00*** | (2006.01) |
| ***H04R 5/04*** | (2006.01) |
| ***H04R 3/12*** | (2006.01) |

(52) U.S. Cl.
CPC ..... *H04S 7/30* (2013.01); *H04R 3/12* (2013.01); *H04R 5/02* (2013.01); *H04R 5/04* (2013.01); *H04R 2203/12* (2013.01); *H04S 2400/11* (2013.01)

(58) Field of Classification Search
CPC ..... H04S 7/30; H04S 2400/11; H04R 3/12; H04R 5/02; H04R 5/04; H04R 2203/12; H04R 1/345; H04R 1/288
See application file for complete search history.

(56) References Cited

U.S. PATENT DOCUMENTS

| | | | | |
|---|---|---|---|---|
| 5,732,143 | A | 3/1998 | Andrea et al. | |
| 8,135,143 | B2 | 3/2012 | Ishibashi et al. | |
| 9,031,267 | B2 * | 5/2015 | Johnston | H04R 3/12 381/104 |
| 2004/0114770 | A1 | 6/2004 | Pompei | |
| 2004/0208324 | A1 | 10/2004 | Pompei | |
| 2007/0133816 | A1 * | 6/2007 | Horrall | G10K 11/175 381/73.1 |
| 2008/0089522 | A1 | 4/2008 | Baba et al. | |
| 2009/0117948 | A1 | 5/2009 | Buck et al. | |
| 2009/0161880 | A1 | 6/2009 | Hooley et al. | |
| 2009/0304211 | A1 * | 12/2009 | Tashev | H04R 3/12 381/182 |
| 2011/0058677 | A1 | 3/2011 | Choi et al. | |
| 2012/0020480 | A1 | 1/2012 | Visser et al. | |

(Continued)

FOREIGN PATENT DOCUMENTS

| | | |
|---|---|---|
| WO | 2012093345 | 7/2012 |
| WO | 2014138134 | 9/2014 |

*Primary Examiner* — Andrew L Sniezek
(74) *Attorney, Agent, or Firm* — Robert C. Kowert; Meyertons, Hood, Kivlin, Kowert & Goetzel, P.C.

(57) ABSTRACT

Some embodiments provide a multi-listener stereo image array which provides multiple separate stereo images of audio content to each of multiple listeners while mitigating interference of audio signals which provide separate stereo images to separate listeners. The array can include sensors which can monitor the environment and can identify relative positions of various listeners and can further control the audio signal patterns generated by the drivers of the array to propagate towards positions associated with particular listeners and be at least partially restricted from propagating towards positions associated with other listeners.

20 Claims, 7 Drawing Sheets

(56) References Cited

U.S. PATENT DOCUMENTS

| | | | | |
|---|---|---|---|---|
| 2013/0064042 | A1* | 3/2013 | Aarts | G01S 7/534 367/99 |
| 2013/0101134 | A1* | 4/2013 | Betts-Lacroix | H04S 7/30 381/80 |
| 2013/0151244 | A1 | 6/2013 | Chen et al. | |
| 2013/0223658 | A1 | 8/2013 | Betlehem et al. | |
| 2015/0223002 | A1 | 8/2015 | Mehta et al. | |
| 2015/0271620 | A1 | 9/2015 | Lando et al. | |
| 2016/0021481 | A1* | 1/2016 | Johnson | H04R 3/12 381/303 |
| 2016/0295342 | A1* | 10/2016 | Miyasaka | G10K 15/08 |

* cited by examiner

MULTI-LISTENER STEREO IMAGE ARRAY

This application claims benefit of priority of U.S. Provisional Application Ser. No. 62/232,819, filed Sep. 25, 2015, which is hereby incorporated by reference herein in its entirety.

BACKGROUND

Technical Field

This disclosure relates generally to stereo speaker arrays, and in particular to a speaker array which provides stereo images of audio content to each of a plurality of listeners.

Description of the Related Art

Stereo sound systems provide a stereo sound experience to a listener based on providing separate channels of audio content which correspond to separate directions out of separate audio speakers, also referred to herein as drivers. The drivers are often positioned with respect to a design position of the listener, so that a driver configured to provide a "left" channel is positioned to the listener's left, and another driver configured to provide a "right" channel is positioned to the listener's right. Collectively the drivers can provide a virtual stereo sound stage, also referred to herein as a stereo image, for the listener where the listener can perceive certain sounds as emanating from various directions, including from virtual sound sources. Sounds intended to be heard from the left end of the sound stage can be preferentially provided via a left driver, so that the listener perceives the sounds as emanating from a sound source to the left of the listener, and sounds intended to be heard from the right end of the sound stage can be preferentially provided via a right driver, so that the listener perceives the sounds as emanating from a sound source to the right of the listener. Furthermore, sounds intended to be heard from the center of the sound stage can be provided equally via both a right and left driver, so that the listener perceives the sounds as emanating from a virtual sound source positioned between the drivers.

In some cases, a listener is not positioned symmetrically between two drivers which are configured to provide a stereo experience. As a result, the listener may perceive sounds generated by one driver more intensely and earlier, relative to sounds generated by another driver, and the stereo sound stage experience can be less than ideal. Such positioning can further occur where multiple listeners are positioned to receive audio content from a stereo sound stage system. Because at least one of the listeners may not be positioned symmetrically relative to all of the drivers providing the stereo sound stage experience, the listener's experience of the stereo sound stage can be less than ideal.

SUMMARY OF EMBODIMENTS

Some embodiments provide an apparatus which includes a multi-listener stereo image array which provides a plurality of separate stereo images of audio content to each of a plurality of listeners. The array includes a set of drivers which are configured to at least partially collectively generate, for each respective listener of the plurality of listeners, a separate audio signal pattern, comprising at least some of the audio content, which is shaped to propagate towards a particular position associated with the respective listener and is at least partially restricted from propagating towards a separate position associated with another listener of the plurality of listeners.

Some embodiments provide a method which includes configuring a multi-listener stereo image array to provide a plurality of separate stereo images of audio content to each of a plurality of listeners. The array includes a set of drivers. The configuring includes adjustably controlling a sound signal output of at least two drivers of the set of drivers, such that the set of drivers at least partially collectively generate, for each respective listener of the plurality of listeners, a separate audio signal pattern, comprising at least some of the audio content, which is shaped to propagate towards a particular position associated with the respective listener and is at least partially restricted from propagating towards a separate position associated with another listener of the plurality of listeners.

Some embodiments provide a non-transitory computer readable medium storing a program of instructions which, when executed by at least one computer system, cause the at least one computer system to configure a multi-listener stereo image array to provide a plurality of separate stereo images of audio content to each of a plurality of listeners. The array includes at least one set of filter banks and a set of drivers which generate audio signals based on filtered outputs generated by the at least one set of filter banks. The configuring comprises controllably adjusting a filtering of at least one audio channel of the audio content, by the at least one set of filter banks, to cause the at least one set of filter banks to provide filtered outputs of at least one channel of the audio content to the set of drivers, which causes at least two drivers of the set of drivers to generate audio signals which collectively provide, for each respective listener of the plurality of listeners, a separate audio signal pattern, comprising at least some of the audio content, which is shaped to propagate towards a particular position associated with the respective listener and is at least partially restricted from propagating towards a separate position associated with another listener of the plurality of listeners.

Figure 1:
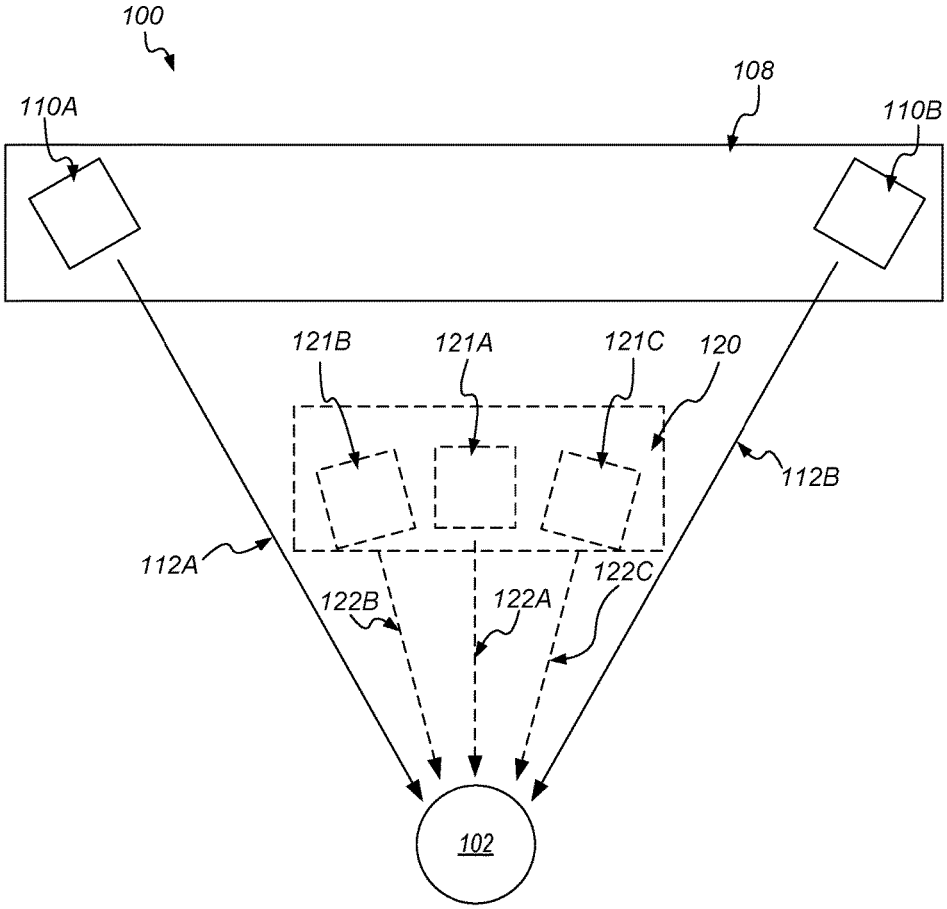
FIG. 1 illustrates a schematic block diagram of a stereo image speaker array which is configured to provide a stereo image of audio content to a listener, according to some embodiments.

This specification includes references to "one embodiment" or "an embodiment." The appearances of the phrases "in one embodiment" or "in an embodiment" do not necessarily refer to the same embodiment. Particular features, structures, or characteristics may be combined in any suitable manner consistent with this disclosure.

"Comprising." This term is open-ended. As used in the appended claims, this term does not foreclose additional structure or steps. Consider a claim that recites: "An apparatus comprising one or more processor units . . . ." Such a claim does not foreclose the apparatus from including additional components (e.g., a network interface unit, graphics circuitry, etc.).

"Configured To." Various units, circuits, or other components may be described or claimed as "configured to" perform a task or tasks. In such contexts, "configured to" is used to connote structure by indicating that the units/circuits/components include structure (e.g., circuitry) that performs those task or tasks during operation. As such, the unit/circuit/component can be said to be configured to perform the task even when the specified unit/circuit/component is not currently operational (e.g., is not on). The units/circuits/components used with the "configured to" language include hardware—for example, circuits, memory storing program instructions executable to implement the operation, etc. Reciting that a unit/circuit/component is "configured to" perform one or more tasks is expressly intended not to invoke 35 U.S.C. § 112, sixth paragraph, for that unit/circuit/component. Additionally, "configured to" can include generic structure (e.g., generic circuitry) that is manipulated by software and/or firmware (e.g., an FPGA or a general-purpose processor executing software) to operate in manner that is capable of performing the task(s) at issue. "Configure to" may also include adapting a manufacturing process (e.g., a semiconductor fabrication facility) to fabricate devices (e.g., integrated circuits) that are adapted to implement or perform one or more tasks.

"First," "Second," etc. As used herein, these terms are used as labels for nouns that they precede, and do not imply any type of ordering (e.g., spatial, temporal, logical, etc.). For example, a buffer circuit may be described herein as performing write operations for "first" and "second" values. The terms "first" and "second" do not necessarily imply that the first value must be written before the second value.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While in this case, B is a factor that affects the determination of A, such a phrase does not foreclose the determination of A from also being based on C. In other instances, A may be determined based solely on B.

DETAILED DESCRIPTION

Reference will now be made in detail to embodiments, examples of which are illustrated in the accompanying drawings. In the following detailed description, numerous specific details are set forth in order to provide a thorough understanding of the present disclosure. However, it will be apparent to one of ordinary skill in the art that some embodiments may be practiced without these specific details. In other instances, well-known methods, procedures, components, circuits, and networks have not been described in detail so as not to unnecessarily obscure aspects of the embodiments.

It will also be understood that, although the terms first, second, etc. may be used herein to describe various elements, these elements should not be limited by these terms. These terms are only used to distinguish one element from another. For example, a first contact could be termed a second contact, and, similarly, a second contact could be termed a first contact, without departing from the intended scope. The first contact and the second contact are both contacts, but they are not the same contact.

The terminology used in the description herein is for the purpose of describing particular embodiments only and is not intended to be limiting. As used in the description and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context.

FIG. 1 illustrates a schematic block diagram of a stereo image speaker array which is configured to provide a stereo image of audio content to a listener, according to some embodiments. Some or all of the array 108 illustrated in FIG. 1 can be included in any of the embodiments of arrays included in any of the embodiments herein.

In some embodiments, a speaker array includes multiple speakers, also referred to herein as drivers, which are configured to collectively provide a stereo image of one or more instances of audio content to a user based on adjustably providing two or more separate channels of the audio content through one or more of the various drivers in the array. As a result, a listener can be provided with a spatial perspective of various sounds included in the audio content, including a perspective of direction and proximity of one or more sound sources to the listener. The stereo image is also referred to herein as a stereo sound stage, as the listener can perceive, via the stereo image, a relative position and direction of various sound sources as if the sound sources were physically positioned in a multi-dimensional stage, image, etc.

As shown in environment 100 of FIG. 1, for example, an array 108 comprises two separate drivers 110A-B which collectively provide a stereo image 120 to a listener 102 positioned between the drivers 110A-B, where the stereo image 120 provided to the listener 102 results in the listener being enabled to perceive virtual sound sources 121A-C which are positioned at various positions in the image 120, relative to the listener 102.

In the illustrated embodiment, driver 110A is a "left" driver which directs a sound signal 112A, also referred to as a signal, to listener 102, and driver 110B is a "right" driver which directs a signal 112B to listener 102. The signal 112A can include at least a portion of a "left" channel of audio content, and the signal 112B can include at least a portion of a "right" channel of the audio content. The signal 112A is received at the listener 102 from a leftwards direction relative to the listener's perspective, and the signal 112B is received at the listener from a rightwards direction relative to the listener's perspective.

In some embodiments, the signals 112A-B generated by drivers 110A-B, also referred to herein as audio signals, collectively provide, to the listener 102, a stereo image 120 of the audio content, so that, as a result, the listener 102 can perceive that the audio content includes one or more various separate sound signals 112A-C being directed to the listener 102 from one or more various virtual sound sources 121A-C positioned in various locations in the stereo image 120. For example, where both drivers 110A-B direct signals 112A-B which include a common sound of the audio content, the listener 102, upon receiving the common sound via both signals 112A-B, may perceive that the sound is being transmitted 112A by a virtual sound source 121 which is located between the drivers 110A-B. In other examples, where a sound is provided preferentially by a particular driver 110A-B, the sound may be mostly or entirely transmitted by an individual signal 112A-B and the listener 102, as a result of receiving the sound via a signal 112A-B which is transmitted from a particular direction relative to the listener 102, perceives the sound as being transmitted 112B-C by a virtual sound source 121B-C which is positioned more proximate to the direction of the signal 112A-B which preferentially includes the sound.

As shown in FIG. 1, listener 102 is positioned approximately symmetrically with respect to drivers 110A-B, so that the listener is positioned in an optimal location to receive signals 112A-B generated by the separate drivers 110A-B in the array. In some embodiments, moving the listener to a position in the environment which results in the drivers being positioned asymmetrically with respect to the listener results in corruption of the stereo image, as the listener may receive signals from one of the drivers before receiving signals from another driver, and signals generated by one driver may be received at a greater intensity (i.e., louder) than equivalent signals generated by another driver. As a result, the stereo image of audio content provided by the drivers can be corrupted so that the listener is at least partially precluded from perceiving spatial distribution of sound sources in the audio content.

In some embodiments, multiple listeners are located in an environment relative to a multi-driver array and at least one of the listeners is positioned asymmetrically with respect to the drivers of the array. For example, the array illustrated in FIG. 1, and furthermore any of the embodiments of arrays included herein, can be included in a vehicle interior, including an interior where array drivers are arranged laterally across a front end of the vehicle and where at least two occupants of the vehicle are positioned laterally across the vehicle interior facing towards the front end. Each occupant can be positioned closer to certain drivers, and more distant from other drivers, than another occupant. As a result, each occupant may perceive signals generated by a given driver in the array differently, so that the stereo image provided to each occupant is different.

Figure 2:
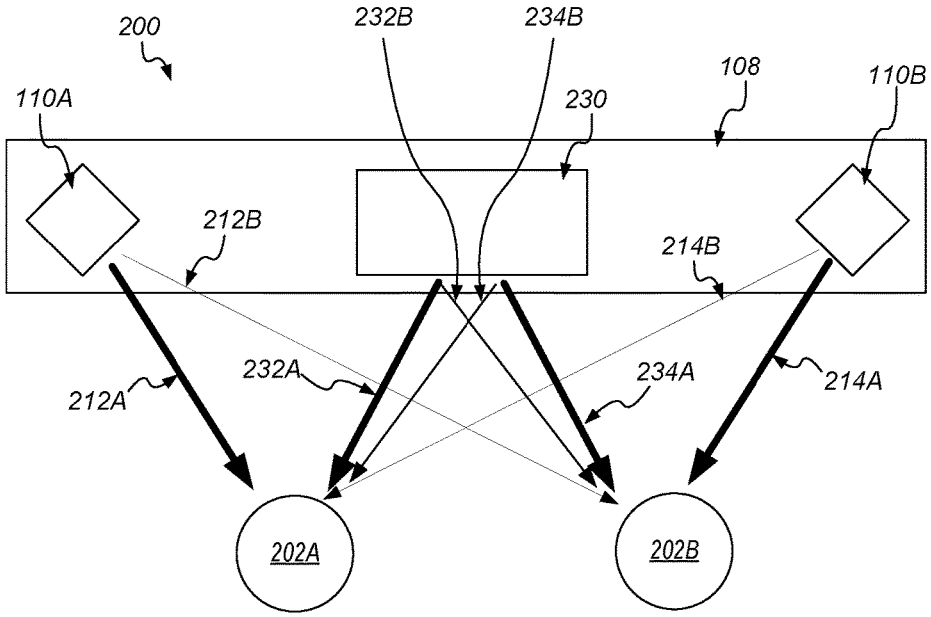
FIG. 2 illustrates a schematic block diagram of a stereo image speaker array which is configured to provide a stereo image of audio content to an environment in which at least some listeners are each positioned in an asymmetrical position relative to the array, according to some embodiments.

FIG. 2 illustrates a schematic block diagram of a stereo image speaker array which is configured to provide a stereo image of audio content to an environment in which at least some listeners are each positioned in an asymmetrical position relative to the array, according to some embodiments. Some or all of the array 108 illustrated in FIG. 2 can be included in any of the embodiments of arrays included in any of the embodiments herein.

As shown, listeners 202A-B are positioned asymmetrically relative to drivers 110A-B of array 108 in environment 200, so that listener 202A is more proximate to driver 110A than listener 202B, and listener 202B is more proximate to driver 110B than listener 202A.

As further shown, because listeners 202A-B are positioned asymmetrically relative to drivers 110A-B, signals 212-214 generated by the drivers 110A-B are perceived differently by the listeners, resulting in dissimilar stereo images being provided to the listeners 202A-B as a result of receiving dissimilar audio signals.

For example, signal 212 generated by driver 110A is received as a more intense signal 212A by listener 202A and is received as a less intense signal 212B by listener 202B, based on the relative proximities of the listeners 202A-B to the driver. Where the signal 212 generated by driver 110A is a "left" channel of audio content, listener 202A receives a stronger left channel signal 212A and listener 202B receives a weaker left channel signal 212B. In addition, as a result of the asymmetrical positions of the listeners 202A-B, the signal 212 generated by driver 110A is perceived as being received from different directions by the separate listeners 202A-B based on the different relative angle of the separate signals 212A-B received by the listeners.

Similarly, signal 214 generated by driver 110B is received as a more intense signal 214A by listener 202B and is received as a less intense signal 214B by listener 202A, based on the relative proximities of the listeners 202A-B to the driver. Where the signal 214 generated by driver 110B is a "right" channel of audio content, listener 202B receives a stronger right channel signal 214A and listener 202A receives a weaker right channel signal 214B. In addition, as a result of the asymmetrical positions of the listeners 202A-B, the signal 214 generated by driver 110B is perceived as being received from different directions by the separate listeners 202A-B based on the different relative angle of the separate signals 214A-B received by the listeners.

As a result, listener 202A, receiving a relatively strong left channel signal 212A and a relatively weak right channel signal 214B which is received after an equivalently-generated left channel signal, perceives a stereo image which is at least partially corrupted by being skewed towards the left driver 110A and by receiving the right channel audio signal later than the left channel audio signal. Similarly, listener 202B, receiving a relatively strong right channel signal 214A and a relatively weak left channel signal 212B which is received after an equivalently-generated right channel signal, perceives a stereo image which is at least partially corrupted by being skewed towards the right driver 110B and by receiving the left channel audio signal later than the right channel audio signal.

In some embodiments, array 108 includes an additional set of drivers 230 which is positioned between multiple listeners 202A-B and is configured to provide multiple channels of the audio content separately to the separate listeners 202A-B as separate signals 232, 234. Such an array 230 can include one set of drivers which generate a particular channel signal 232A which is directed to listener 202A and another set of drivers which generate another channel signal 234A which is directed to listener 202B. In some embodiments, multiple drivers in the set 230 provide both signals 232-234. The signal 232A provided to listener 202A can comprise the signal 214A directed to listener 202B, so that listener 202A receives the signal 232A symmetrically with regard to signal 212A, thereby providing a symmetrical stereo image. Similarly, the signal 234A provided to listener 202B can comprise the signal 212A directed to listener 202A, so that listener 202B receives the signal 234A symmetrically with regard to signal 214A, thereby providing a symmetrical stereo image.

In some embodiments, a signal directed to one listener in an environment can propagate to another listener in an environment, which can result in interference where a common signal is received at a listener from different sources. Where the different sources are located at various distances from the listener, the common signal can be received at multiple different times, thus resulting in corruption of the stereo image provided to the listener.

For example, as shown in FIG. 2, signal 232 which propagates to listener 202A also propagates, as signal 232B, to listener 202B. Where the signal 232 includes a common signal with signal 214, listener 202B receives the common signal both from the right, via signal 214A, and from the left at a different time, via signal 232B. Similarly, as shown in FIG. 2, signal 234 which propagates to listener 202B also propagates, as signal 234B, to listener 202A. Where the signal 234 includes a common signal with signal 212, listener 202A receives the common signal both from the left, via signal 212A, and from the right at a different time, via signal 234B. As a result, the stereo images provided to both listeners 202A-B can be corrupted as a result of signals directed to a listener propagating to another listener.

Figure 3:
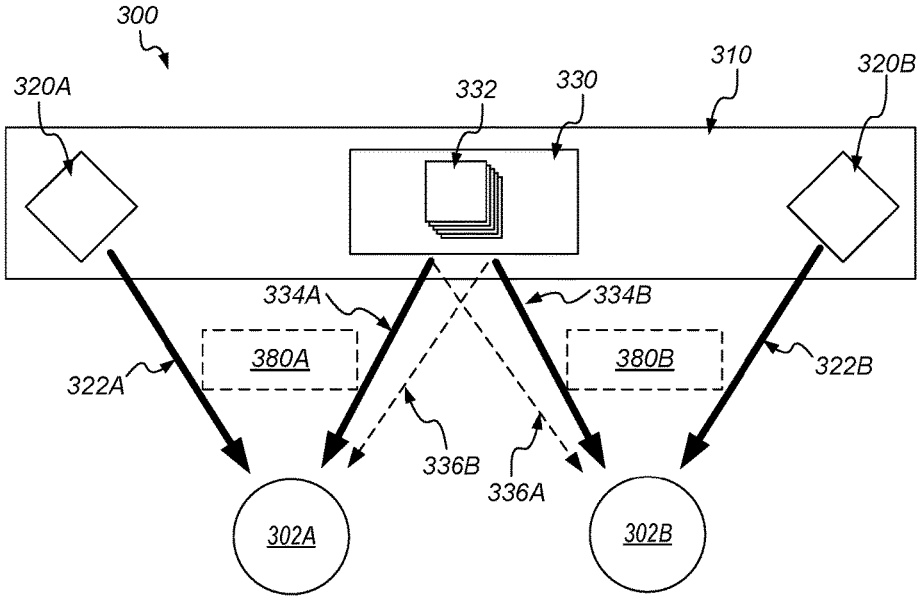
FIG. 3 illustrates a schematic block diagram of a stereo image speaker array which is configured to provide a stereo image of audio content to an environment in which at least some listeners are each positioned in an asymmetrical position relative to the array, according to some embodiments.

FIG. 3 illustrates a schematic block diagram of a stereo image speaker array which is configured to provide a stereo image of audio content to an environment in which at least some listeners are each positioned in an asymmetrical position relative to the array, according to some embodiments. Some or all of the array 310 illustrated in FIG. 3 can be included in any of the embodiments of arrays included in any of the embodiments herein.

In some embodiments, a set of drivers included in an array are configured to adjustably control signals which are directed to separate listeners as part of providing separate and substantially similar symmetrical stereo images of audio content to the separate listeners. The set of drivers can, for each listener, generate a separate audio signal pattern which is shaped, based on the directivity index associated with the pattern, to propagate towards the given listener and is at least partially restricted from propagating to at least one other listener. Such generating can be referred to as generating a separate audio signal pattern which is shaped, based on the directivity index associated with the pattern, to at least partially maximize an intensity, sound level, etc. of the signal pattern in a direction towards a particular listener and at least partially restrict, inhibit, etc. an intensity, sound level, etc. of the signal pattern in a direction towards at least one other listener. Such adjustable control can be implemented via various beamforming techniques, which can be implemented via adjustable control of one or more sets of filter banks, included in the array, which filter one or more channels of the audio content and provide such filtered output to one or more drivers in the array. An audio signal pattern, also referred to interchangeably as a audio directivity pattern, audio beam pattern, etc., which is configured to propagate towards a particular listener, position, etc. can include an audio signal pattern which is configured, based at least in part upon a directivity of the signal pattern, to be directed towards the particular listener, position, etc. for which the intensity of the signal pattern is to be maximized. A shape of the audio signal pattern can be based on the directivity of the signal pattern, which can be based on a directivity index associated with the signal pattern. The directivity index of a signal pattern generated by the array can describe an intensity, sound level, etc. of the signal pattern in a particular direction, which can also be a characterization of the magnitude of propagation of the signal in a given direction based on at least a frequency of the signal, a circumferential angle of the direction relative to the array, and an elevation angle of the direction relative to the array.

As a result, as shown for example in FIG. 3, where array 310 is configured to provide separate stereo images 380 of audio content to both listeners 302A-B, the array comprises a left driver 320A which directs a left channel signal 322A to listener 302A, a right driver 320B which directs a right channel signal 322B to listener 302B, and a set 330 of drivers 322 which collectively provide right channel signal 334A to listener 302A while restricting 336A the signal 334A from propagating to listener 302B and provide left channel signal 334B to listener 302B while restricting 336B the signal 334B from propagating to listener 302A. Each of signals 322A-B, 334A-B can comprise a separate signal pattern.

Therefore, listener 302A receives left channel signal 322A and right channel signal 334A at least partially free of interference from signal 334B, thereby providing stereo image 380A to listener 302A via signals 322A, 334A, while listener 302B receives right channel signal 322B and left channel signal 334B at least partially free of interference from signal 334A, thereby providing stereo image 380B to listener 302B via signals 322B, 334B. As a result, the stereo images 380A-B of audio content provided to listeners 302A-B, where each listener is positioned asymmetrically to the drivers 320A-B, 332 of the array 310, are substantially similar to a stereo image of the audio content which can be provided to a listener positioned symmetrically to the drivers of the array, including the stereo image 120 illustrated and discussed with regard to FIG. 1, based at least in part upon the at least partial restriction of an intensity of signal patterns 334A-B which are directed to separate listeners 302A-B towards other listeners 302B-,A which could corrupt the resulting stereo images 380 perceived by one or more of the listeners 302A-B.

In some embodiments, signal patterns 322A, 334A include separate audio content from the audio content included in signal patterns 322B, 334B. As a result, the stereo images 380A-B of audio content comprise separate stereo images of separate audio content, and configuring the signal patterns 334A-B to restrict propagation 336A-B results in the separate stereo images 380A-B provided to each listener 302A-B being rendered at least partially free of interference from audio content provided to another listener 302A-B.

Figure 4A:
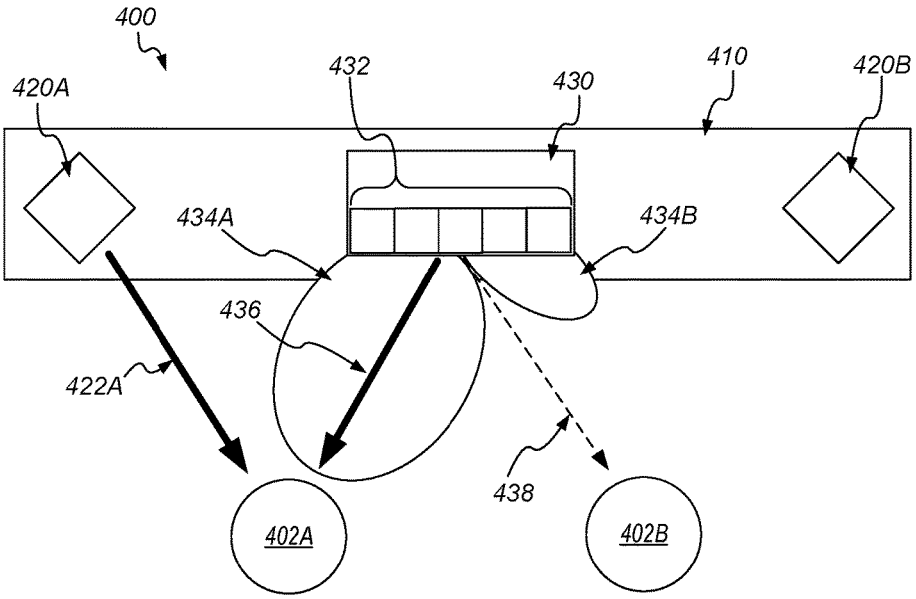
FIG. 4A-B illustrate a schematic block diagram of a stereo image speaker array which is configured to provide a stereo image of audio content to an environment in which at least some listeners are each positioned in an asymmetrical position relative to the array, according to some embodiments.
Figure 4B:
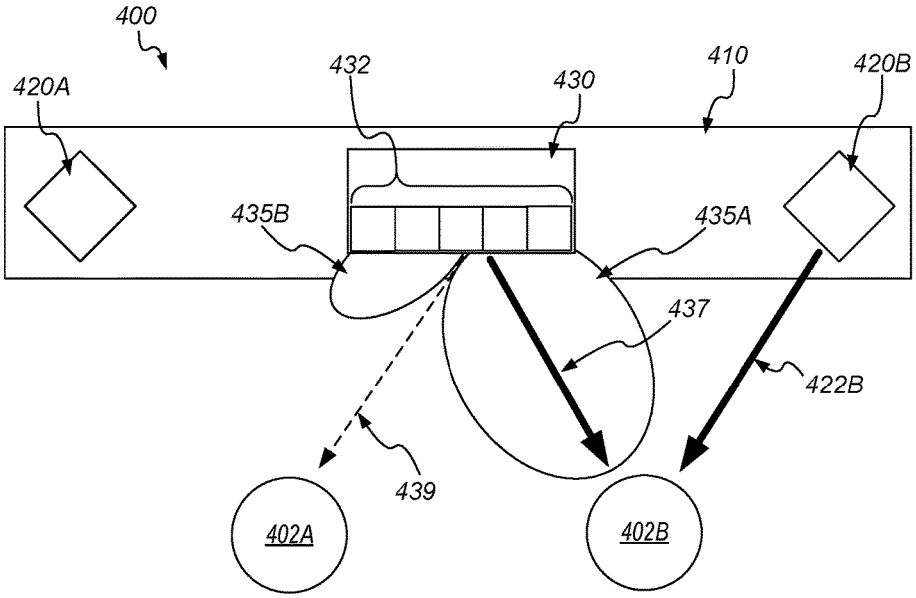

FIG. 4A-B illustrate a schematic block diagram of a stereo image speaker array which is configured to provide a stereo image of audio content to an environment in which at least some listeners are each positioned in an asymmetrical position relative to the array, according to some embodiments. Some or all of the array 410 illustrated in FIG. 4A-B can be included in any of the embodiments of arrays included in any of the embodiments herein.

As shown, in FIG. 4A-B, the set 430 of drivers 432 can be adjustably controlled, via controlling one or more of phase, frequency; beamforming, etc., to adjust the propagation, directivity, intensity, etc. of multiple separate audio signal patterns through various directions in an environment so that at least one audio signal pattern, also referred to herein as an "audio directivity pattern", "signal pattern", etc., is shaped to increase intensity towards a target listener at is at least partially restricted, inhibited, etc. in intensity towards at least one other listener. Set 430 of drivers 432 collectively direct 436 the signal in a signal pattern 434A-B which is shaped to propagate towards listener 402A and further features a "notch" 438 in the shape of the pattern 434A-B where the signal is at least partially absent and which is directed, as shown by arrow 438, towards listener 402B. The shape of the pattern 434 can be based on the directivity index associated with the pattern, where shaping the pattern 434 as shown in FIG. 4A comprises adjusting the directivity index associated with the pattern so that the directivity index, or intensity of the pattern 434, in the direction 436 of the listener 402A is maximized (i.e., propagation in the direction 436 is maximized) and the directivity index, or intensity of the pattern 434, in the direction 438 of the listener 402B is minimized As a result, listener 402A receives the signal included in the signal pattern 434, and the signal pattern 434, and thus the signal, is at least partially restricted from being received by listener 402B. Similarly, set 430 of drivers 432 collectively direct another signal directed 437 towards listener 402B in a signal pattern 435A-B which is shaped to propagate towards listener 402B and further features a "notch" 439 in shape of the pattern 435 where the signal is at least partially absent and which is directed 439 towards listener 402A. As a result, listener 402B receives signal 437, and the signal is at least partially restricted from being received by listener 402A.

When the signals 422A-B generated by drivers 420A-B, also referred to as signal provided by the drivers, are provided along with signal patterns 434-435 provided by the set 430 of drivers 432, signal patterns 422A and 436 are directed towards listener 402A and signal patterns 422B and 437 are directed towards listener 402B while at least partially mitigating the propagation of signal pattern 434 to listener 402B via notch 438 in the shape of the pattern 434 and at least partially mitigating the propagation of signal pattern 435 to listener 402A via notch 439 in the shape of the pattern 435, thereby reducing corruption of the stereo images provided to the separate listeners 402A-B.

In some embodiments, the audio content comprised in the signal patterns 422A, 434 is separate from the audio content comprised in the signal patterns 422B, 435, so that the separate listeners 402A-B are provided with separate stereo images of separate instances of audio content.

Figure 5:
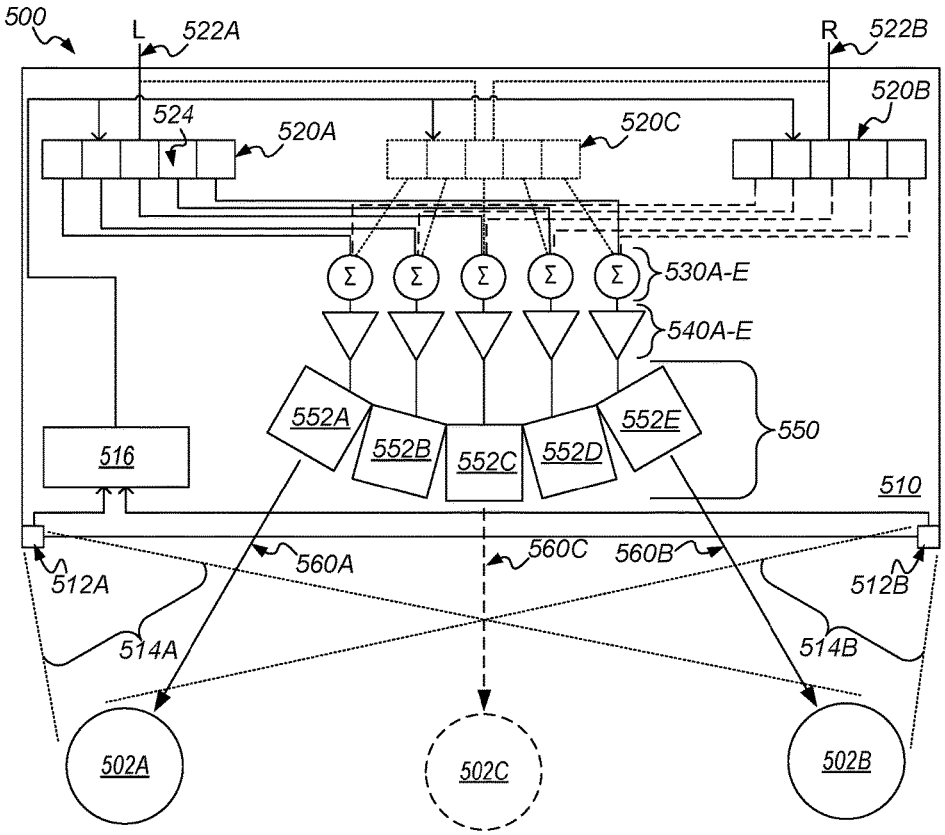
FIG. 5 illustrates a schematic block diagram of a stereo image speaker array which is configured to provide a stereo image of audio content to an environment in which at least some listeners are each positioned in an asymmetrical position relative to the array, according to some embodiments.

FIG. 5 illustrates a schematic block diagram of a stereo image speaker array which is configured to provide a stereo image of audio content to an environment in which at least some listeners are each positioned in an asymmetrical position relative to the array, according to some embodiments. Some or all of the array illustrated in FIG. 5 can be included in any of the embodiments of arrays included in any of the embodiments herein.

In some embodiments, to controllably adjust one or more sets of drivers in an array to cause the array to provide separate, symmetrical stereo images to separate listeners, the array includes one or more sets of sensor devices which can monitor the environment in which the array is located. The array can, based at least in part upon processing sensor data representations of the environment which are generated by the sensor devices, identify listeners in the environment, including relative positions of the listeners, hearing organs of the listeners, etc. in the environment. The array can adjustably control the signals generated by drivers included in the array based on the identification of listeners so that signal patterns which are directed to the separate listeners from at least one set of drivers in the array are at least partially restricted from propagating to other listeners.

Based on the determined positions of listeners in the environment, one or more portions of the array can adjustably control one or more filter banks which filter one or more channels of audio content for one or more particular drivers in a set of drivers so that separate signals generated by the set of drivers propagate towards particular listeners and area at least partially restricted from propagating to other listeners via one or more various techniques, including beamforming.

In some embodiments, propagation of a signal, signal pattern, etc. towards a particular direction can be referred to interchangeably as referring to an intensity, magnitude, etc. of the signal in the particular direction.

FIG. 5 shows an environment 500 in which an array 500 and listeners 502A-B are located. Array 500 includes a set of sensor devices 512A-B which monitor 514A-B one or more portions of the environment 500 in which the listeners are located. The one or more sensor devices 512A-B can include one or more camera devices, light beam scanning devices, ultrasonic sensor devices, radar devices, some combination thereof, etc. A sensor device can generate a sensor data representation of the portion of the environment which is monitored by the sensor device.

Sensor data generated by the sensor devices 512A-B can be provided to a processor 516 which processes the sensor data generated by sensor devices 512A-B and, based at least in part upon the processing, identifies the listeners 502A-B in the environment 500, including identifying relative positions of the listeners 502A-B relative to the array 510.

Based on the determined positions of the listeners 502A-B relative to array 510, processor 516 determines a configuration of one or more various banks 520 of audio filters 524 which results in the drivers 552 of a set 550 provided the output of said filters directing separate signals of audio content towards the separate listeners, where the configuration results in a given signal pattern directed towards a particular listener is controlled to at least partially be restricted from propagating to another listener. Such control can include determining a filter bank configuration which results in a signal directed towards a given listener featuring a "notch", based on beamforming, signal phase control, etc. which is directed towards another listener so that the other listener is at least partially precluded from receiving the signal directed towards the given listener. In some embodiments, processor 516 configuration of one or more various banks 520 of audio filters 524 which results in the drivers 552 of a set 550 provided the output of said filters directing separate signals of audio content towards the separate listeners in separate signal patterns which are associated with separate directivity indices which results in each separate signal pattern being shaped to maximize signal sensitivity in a direction towards a particular listener and to minimize signal sensitivity in a direction towards at least one other particular listener.

As shown, the output of the processor 516 is communicated to various filter banks 520A-B which each correspond to a separate channel 522A-B of audio content received at the array 510. The output of the processor 516 can include command signals generated based on a selected filter bank configuration which, when received at the various filter banks 520A-B, causes the filter banks to be adjustably controlled to adjustably control the output of the various filters 524 in the various banks 520 according to the determined filter bank configuration at processor 516. As shown, bank 520A of filters 524 receives left channel content 522A and bank 520B of filters 524 receives right channel content 522B. Each separate filter 524 in a given bank 520 corresponds to a separate driver 552 in set 550 and the output of a given filter in a bank 520 is provided to a particular driver 552. As discussed further below, outputs from separate filters in separate banks can be provided to a common driver.

The separate filters 524 in the separate banks 520A-B are adjustably controlled by the processor 516 based on the determined positions of the listeners 502A-B so that the outputs of the various filter banks 520A-B, when combined by the summation elements 530A-E and passed through separate amps 540A-E to separate drivers 552A-E, result in the drivers 552A-E at least partially collectively providing separate signals 560A-B which are directed towards particular separate listeners 502A-B and are at least partially restricted from being directed towards other listeners.

As shown in FIG. 5, in some embodiments, the array 510 is configured to direct more than two separate signals to two separate listeners. In some embodiments, the array 510 is configured to adjustably control particular filter banks to cause one or more of the drivers 552 to provide a particular signal which is directed towards a particular listener and is at least partially restricted from propagating towards the particular direction of one or more other particular listeners. For example, where an additional listener 502C is located between listeners 502A-B, processor 516 can identify the location of the listener 502 based on processing sensor data generated by the sensor devices 512A-B monitoring the environment and can determine a filter bank configuration which directs separate signals 560A-C to the separate listeners 502A-C so that each signal 560 is directed towards the position of a particular listener 502 and is at least partially restricted from propagating towards at least one other of the listeners. As shown, the array 510 can include one or more filter banks 520C which can filter content from multiple channels 522A-B and can provide an output which causes one or more of the drivers 552 to direct signal 560C to listens 502C. In some embodiments, bank 520C is absent and banks 520A-B are adjustably controlled to provide outputs which, when provided to drivers 552, cause the drivers 552 to provide at least the three separate signals 560A-C which are directed towards the three separate listeners 502A-C.

In some embodiments, a set 530 of drivers included in the array 510 are arranged to direct at least some of the drivers 552 in separate directions, as shown in FIG. 5. In some embodiments, directionality of a signal generated at one or more various drivers 552 in a set 530 is based at least in part upon a frequency of the signal. As the frequency of the signal increases, the directionality of a signal pattern provided by a given driver can increase, such that a particular directional signal 560A-C with a sufficiently high frequency can be directed to a particular listener, while at least partially restricting the signal from being directed to another listener, via generating the signal at one or more drivers which are physically directed towards the listener.

For example, in FIG. 5, where signal patterns 560A-C are of sufficiently high directivity, based at least in part upon signal frequency at least meeting a certain threshold value, such that a determination can be made that the signal pattern can be directed to a given listener independent of other listeners via an individual driver, driver 552A alone can direct signal pattern 560A to listener 502A independently of listeners 502B-C, based on driver 552A being physically directed towards listener 502A. Similarly, driver 552C can generate signal pattern 560C directed towards listener 502C and driver 552B can generate signal pattern 560B directed towards listener 502B.

As a result, the set of drivers 552 is configured to provide signal patterns to separate listeners, while restricting said signals from propagating towards other listeners, across a broad spectrum of signal frequencies which includes frequencies at which the signals become highly directional.

Figure 6:
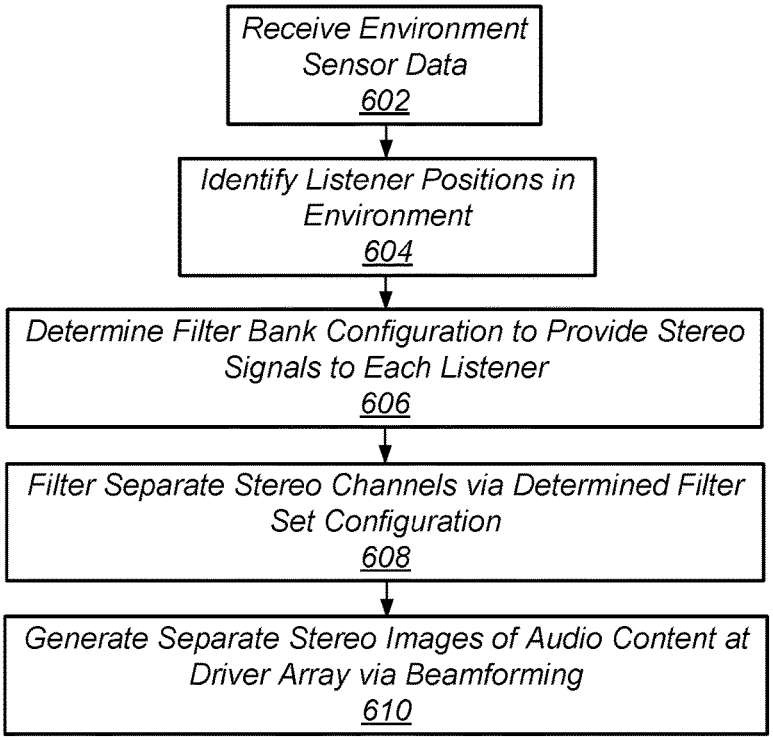
FIG. 6 illustrates providing a separate stereo image of audio content to each of a plurality of listeners, according to some embodiments.

FIG. 6 illustrates providing a separate stereo image of audio content to each of a plurality of listeners, according to some embodiments. The providing can be implemented by one or more portions of any embodiment of the multi-listener stereo imaging array included in any embodiments herein. One or more portions of the array can be implemented by one or more computer systems.

At 602, environment sensor data, generated by one or more sensor devices monitoring a listener environment, is received. The data can include one or more sensor data representations of one or more portions of the environment. In some embodiments, sensor data generated by multiple sensor devices provides a stereo image of the environment.

At 604, two or more listeners are identified in the environment, based on processing the received sensor data. Identifying a listener can include identifying a location of listener body parts, including listener heads, ears, etc., via processing one or more sensor data representations of the environment. Identifying a location of a listener, body parts of the listener, etc. can include determining a relative position of the listener, body parts, etc. relative to one or more portions of the array, including relative to one or more particular sets of drivers included in the array.

At 606, a determination is made of a particular filter bank configuration which, when applied, via one or more sets of filter banks, to audio content which is to be provided to the environment causes the audio content to be provided to each listener via a separate and substantially identical stereo image where at least some signal patterns directed to one listener are at least partially restricted from being directed to another listener. The filter bank configuration can include selecting a particular set of filters with which to apply to the audio content, where the particular set of filters is configured to provide, via signal patterns generated by one or more sets of drivers, separate stereo images to a set of listeners which approximates the quantity and relative positions of the listeners identified at 604. The filtering set configuration can include a set of filter banks which are configured, via one or more stereo image algorithm processes, to provide separate sets of audio signals to separate listeners via beamforming, so that a signal directed to one listener as a channel of the stereo image is at least partially nullified in the direction of another listener. The filter bank configuration can be configured to provide separate channels of audio content which are directed to separate listeners and are at least partially nullified in the direction of other listeners via a common set of drivers. A filter bank configuration can be a configuration of one or more filter banks which results in one or more signal patterns being generated by one or more drivers being associated with a directivity index which maximizes signal propagation towards a direction associated with a particular listener and minimizes signal propagation towards another direction associated with a separate listener.

Determining a filter bank configuration can include determining a filter bank configuration which, when applied to one or more channels of audio content and provided to one or more sets of drivers in the array, results in the drivers providing separate sets of audio signal patterns to separate listeners which provide separate stereo images of the audio content for each listener while at least partially restricting signals provided as part of a stereo image for one listener from being received by another listener, thereby mitigating corruption of each listener's stereo image.

Determining the filter bank configuration can include communicating the configuration to one or more sets of filters, also referred to herein as one or more filter banks, adjustably controlling operation of one or more sets of filters, some combination thereof, etc.

At 608, separate stereo channels of the audio content are received and filtered by one or more sets of filters according to the filter bank configuration determined at 606. At 610, the output of the filter banks is provided to one or more sets of drivers in the array, which causes separate channels of the audio content to be provided to each of the separate listeners identified at 604 according to the audio signal configuration determined at 606, thereby providing separate stereo images to each listener.

Figure 7:
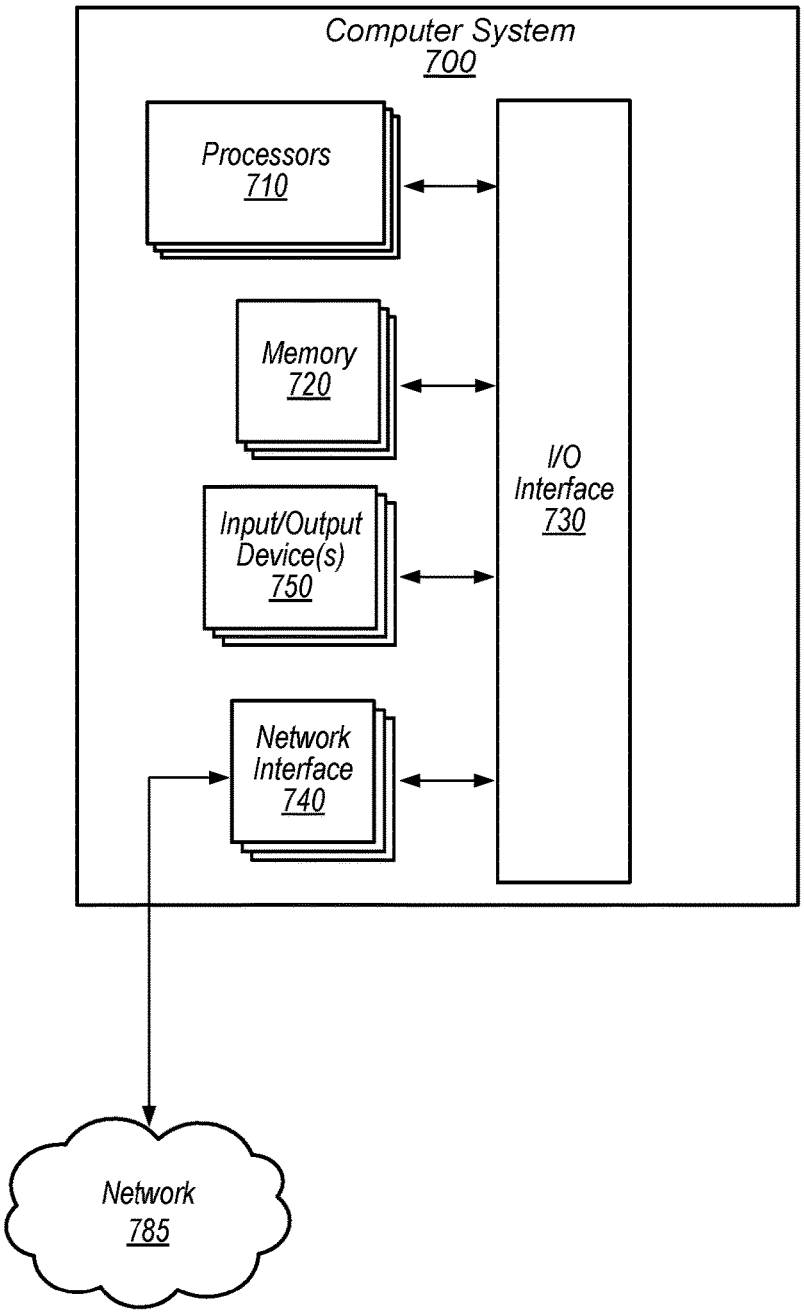
FIG. 7 illustrates a computer system that may be configured to include or execute any or all of the embodiments described herein.

FIG. 7 illustrates an example computer system 700 that may be configured to include or execute any or all of the embodiments described above. In different embodiments, computer system 700 may be any of various types of devices, including, but not limited to, a personal computer system, desktop computer, laptop, notebook, tablet, slate, pad, or netbook computer, cell phone, smartphone, PDA, portable media device, mainframe computer system, handheld computer, workstation, network computer, a camera or video camera, a set top box, a mobile device, a consumer device, video game console, handheld video game device, application server, storage device, a television, a video recording device, a peripheral device such as a switch, modem, router, or in general any type of computing or electronic device.

Various embodiments of multi-listener stereo image array, as described herein, may be executed in one or more computer systems 700, which may interact with various other devices. Note that any component, action, or functionality described above with respect to FIGS. 1 through 6 may be implemented on one or more computers configured as computer system 700 of FIG. 7, according to various embodiments. In the illustrated embodiment, computer system 700 includes one or more processors 710 coupled to a system memory 720 via an input/output (I/O) interface 730. Computer system 700 further includes a network interface 740 coupled to I/O interface 730, and one or more input/output devices, which can include one or more user interface (also referred to as "input interface") devices. In some cases, it is contemplated that embodiments may be implemented using a single instance of computer system 700, while in other embodiments multiple such systems, or multiple nodes making up computer system 700, may be configured to host different portions or instances of embodiments. For example, in one embodiment some elements may be implemented via one or more nodes of computer system 700 that are distinct from those nodes implementing other elements.

In various embodiments, computer system 700 may be a uniprocessor system including one processor 710, or a multiprocessor system including several processors 710 (e.g., two, four, eight, or another suitable number). Processors 710 may be any suitable processor capable of executing instructions. For example, in various embodiments processors 710 may be general-purpose or embedded processors implementing any of a variety of instruction set architectures (ISAs), such as the x86, PowerPC, SPARC, or MIPS ISAs, or any other suitable ISA. In multiprocessor systems, each of processors 710 may commonly, but not necessarily, implement the same ISA.

System memory 720 may be configured to store program instructions, data, etc. accessible by processor 710. In various embodiments, system memory 720 may be implemented using any suitable memory technology, such as static random access memory (SRAM), synchronous dynamic RAM (SDRAM), nonvolatile/Flash-type memory, or any other type of memory. In the illustrated embodiment, program instructions included in memory 720 may be configured to implement some or all of an ANS, incorporating any of the functionality described above. Additionally, existing control data of memory 720 may include any of the information or data structures described above. In some embodiments, program instructions and/or data may be received, sent or stored upon different types of computer-accessible media or on similar media separate from system memory 720 or computer system 700. While computer system 700 is described as implementing the functionality of functional blocks of previous Figures, any of the functionality described herein may be implemented via such a computer system.

In one embodiment, I/O interface 730 may be configured to coordinate I/O traffic between processor 710, system memory 720, and any peripheral devices in the device, including network interface 740 or other peripheral interfaces, such as input/output devices 750. In some embodiments, I/O interface 730 may perform any necessary protocol, timing or other data transformations to convert data signals from one component (e.g., system memory 720) into a format suitable for use by another component (e.g., processor 710). In some embodiments, I/O interface 730 may include support for devices attached through various types of peripheral buses, such as a variant of the Peripheral Component Interconnect (PCI) bus standard or the Universal Serial Bus (USB) standard, for example. In some embodiments, the function of I/O interface 730 may be split into two or more separate components, such as a north bridge and a south bridge, for example. Also, in some embodiments some or all of the functionality of I/O interface 730, such as an interface to system memory 720, may be incorporated directly into processor 710.

Network interface 740 may be configured to allow data to be exchanged between computer system 700 and other devices attached to a network 785 (e.g., carrier or agent devices) or between nodes of computer system 700. Network 785 may in various embodiments include one or more networks including but not limited to Local Area Networks (LANs) (e.g., an Ethernet or corporate network), Wide Area Networks (WANs) (e.g., the Internet), wireless data networks, some other electronic data network, or some combination thereof. In various embodiments, network interface 740 may support communication via wired or wireless general data networks, such as any suitable type of Ethernet network, for example; via telecommunications/telephony networks such as analog voice networks or digital fiber communications networks; via storage area networks such as Fibre Channel SANs, or via any other suitable type of network and/or protocol.

Input/output devices may, in some embodiments, include one or more display terminals, keyboards, keypads, touchpads, scanning devices, voice or optical recognition devices, or any other devices suitable for entering or accessing data by one or more computer systems 700. Multiple input/output devices may be present in computer system 700 or may be distributed on various nodes of computer system 700. In some embodiments, similar input/output devices may be separate from computer system 700 and may interact with one or more nodes of computer system 700 through a wired or wireless connection, such as over network interface 740.

Memory 720 may include program instructions, which may be processor-executable to implement any element or action described above. In one embodiment, the program instructions may implement the methods described above. In other embodiments, different elements and data may be included. Note that data may include any data or information described above.

Those skilled in the art will appreciate that computer system 700 is merely illustrative and is not intended to limit the scope of embodiments. In particular, the computer system and devices may include any combination of hardware or software that can perform the indicated functions, including computers, network devices, Internet appliances, PDAs, wireless phones, pagers, etc. Computer system 700 may also be connected to other devices that are not illustrated, or instead may operate as a stand-alone system. In addition, the functionality provided by the illustrated components may in some embodiments be combined in fewer components or distributed in additional components. Similarly, in some embodiments, the functionality of some of the illustrated components may not be provided and/or other additional functionality may be available.

Those skilled in the art will also appreciate that, while various items are illustrated as being stored in memory or on storage while being used, these items or portions of them may be transferred between memory and other storage devices for purposes of memory management and data integrity. Alternatively, in other embodiments some or all of the software components may execute in memory on another device and communicate with the illustrated computer system via inter-computer communication. Some or all of the system components or data structures may also be stored (e.g., as instructions or structured data) on a computer-accessible medium or a portable article to be read by an appropriate drive, various examples of which are described above. In some embodiments, instructions stored on a computer-accessible medium separate from computer system 700 may be transmitted to computer system 700 via transmission media or signals such as electrical, electromagnetic, or digital signals, conveyed via a communication medium such as a network and/or a wireless link. Various embodiments may further include receiving, sending or storing instructions and/or data implemented in accordance with the foregoing description upon a computer-accessible medium. Generally speaking, a computer-accessible medium may include a non-transitory, computer-readable storage medium or memory medium such as magnetic or optical media, e.g., disk or DVD/CD-ROM, volatile or non-volatile media such as RAM (e.g. SDRAM, DDR, RDRAM, SRAM, etc.), ROM, etc. In some embodiments, a computer-accessible medium may include transmission media or signals such as electrical, electromagnetic, or digital signals, conveyed via a communication medium such as network and/or a wireless link.

The methods described herein may be implemented in software, hardware, or a combination thereof, in different embodiments. In addition, the order of the blocks of the methods may be changed, and various elements may be added, reordered, combined, omitted, modified, etc. Various modifications and changes may be made as would be obvious to a person skilled in the art having the benefit of this disclosure. The various embodiments described herein are meant to be illustrative and not limiting. Many variations, modifications, additions, and improvements are possible. Accordingly, plural instances may be provided for components described herein as a single instance. Boundaries between various components, operations and data stores are somewhat arbitrary, and particular operations are illustrated in the context of specific illustrative configurations. Other allocations of functionality are envisioned and may fall within the scope of claims that follow. Finally, structures and functionality presented as discrete components in the example configurations may be implemented as a combined structure or component. These and other variations, modifications, additions, and improvements may fall within the scope of embodiments as defined in the claims that follow.

What is claimed is:

1. An apparatus, comprising:

a speaker array which is configured to provide a plurality of listener-specific sound stages of audio content to each of a plurality of listeners, wherein the speaker array comprises:

a set of one or more sensor devices which are configured to generate one or more sensor data representations of an environment in which the speaker array is located;

a processor which is configured to identify a different position associated with each respective listener, of the plurality of listeners, based on processing the one or more sensor data representations; and a set of drivers which are configured to at least partially collectively generate, for each respective listener of the plurality of listeners, a listener-specific audio signal pattern, comprising at least some of the audio content, which is shaped, based on a directivity index associated with the audio signal pattern, to at least partially inhibit an intensity of the audio signal pattern in a direction towards the position associated with another listener of the plurality of listeners, wherein the set of drivers is configured to generate, at least partially concurrently, the listener-specific audio signal patterns in different directions towards the positions associated with each respective listener.

2. The apparatus of claim 1, wherein:

the speaker array is configured to, based on the identified positions of the plurality of listeners, adjustably control the shape of each listener-specific audio signal pattern, based on adjustably controlling the directivity index associated with each listener-specific audio signal pattern, such that each listener-specific audio signal pattern is shaped to:

provide at least a certain intensity of the audio signal pattern in a particular direction towards a particular identified position associated with a particular identified listener of the plurality of listeners, and at least partially inhibit the intensity of the audio signal pattern in a particular direction towards a listener-specific position associated with a listener of the plurality of listeners.

3. The apparatus of claim 2, wherein, to adjustably control a shape of each listener-specific audio signal pattern based on the identified positions of the plurality of listeners, the speaker array is configured to, for each audio signal pattern:

adjustably control the directivity index associated with the listener-specific audio signal pattern so that the audio signal pattern comprises:

a maximized intensity of the audio signal pattern in the particular direction towards the particular identified position associated with the particular identified listener, and a minimized intensity of the audio signal pattern in the particular direction towards the listener-specific position associated with the listener.

4. The apparatus of claim 3, wherein, to adjustably control a shape of each listener-specific audio signal pattern, the speaker array is configured to:

adjustably control audio signals generated by at least two drivers, of the set of drivers, such that the audio signals generated by the at least two drivers adjustably control a shape of at least one audio signal pattern to conform to a particular directivity index associated with the audio signal pattern, via beamforming.

5. The apparatus of claim 4, wherein:

the speaker array comprises at least one set of filter banks, wherein each filter bank comprises a plurality of filters which are each configured to provide a filtered output of at least one channel of the audio content to a separate driver of the set of drivers; and to adjustably control audio signals generated by the at least two drivers, such that the audio signals generated by the at least two drivers adjustably control a shape of at least one audio signal pattern via beamforming, the speaker array is configured to:

determine a particular filter bank configuration which, when implemented, causes the at least one set of filter banks to provide filtered outputs which, when provided to the set of drivers, causes the at least two drivers to generate audio signals which collectively generate the at least one audio signal pattern which is associated with a particular directivity index via beamforming; and adjustably control the at least one set of filter banks to cause the at least one set of filter banks to filter one or more channels of the audio content according to the particular filter bank configuration.

6. The apparatus of claim 5, wherein:

to determine the particular filter bank configuration, the speaker array is configured to select, of a plurality of sets of filter banks, a particular set of filter banks based on a determination that the particular set of filter banks is configured to provide a filtered output of at least one channel of the audio content to at least two drivers of the set of drivers to cause the at least two drivers to generate audio signals which collectively generate the at least one audio signal pattern via beamforming.

7. The apparatus of claim 2, wherein:

the set of drivers are positioned such that each separate driver, of the set of drivers, faces in a different direction; and to, based on the identified positions of the plurality of listeners, adjustably control the shape of each listener-specific audio signal pattern, based on adjustably controlling the directivity index associated with each listener-specific audio signal pattern, the speaker array is configured to:

cause an individual driver, of the set of drivers, to generate the audio signal pattern, based on a determination that the individual driver is facing in a particular direction towards the particular identified position associated with the particular identified listener of the plurality of listeners and that the directivity index associated with the audio signal pattern at least meets a particular directivity threshold value.

8. A method, comprising:

configuring a speaker array, which comprises a set of drivers, to provide a plurality of listener-specific sound stages of audio content to each of a plurality of listeners, wherein the speaker array further comprises a set of one or more sensor devices which are configured to generate one or more sensor data representations of an environment in which the speaker array is located, and wherein the configuring comprises:

identifying a different position associated with each respective listener, of the plurality of listeners, based on processing the one or more sensor data representations; and adjustably controlling audio signals generated by at least two drivers of the set of drivers, such that the set of drivers at least partially collectively generate, for each respective listener of the plurality of listeners, a listener-specific audio signal pattern, comprising at least some of the audio content, which is shaped, based on a directivity index associated with the audio signal pattern, to at least partially inhibit an intensity of the audio signal pattern in a direction towards the position associated with another listener of the plurality of listeners, wherein the at least two drivers are configured to generate, at least partially concurrently, the listener-specific audio signal patterns in different directions towards the positions associated with each respective listener.

9. The method of claim 8, wherein:

the configuring comprises:

adjustably controlling a shape of each listener-specific audio signal pattern, based on the identified positions of the plurality of listeners and adjustably controlling the directivity index associated with each listener-specific audio signal pattern, such that each listener-specific audio signal pattern is shaped to:

provide at least a certain intensity of the audio signal pattern in a particular direction towards a particular identified position associated with a particular identified listener of the plurality of listeners, and at least partially inhibit the intensity of the audio signal pattern in a particular direction towards a listener-specific position associated with a listener of the plurality of listeners.

10. The method of claim 9, wherein adjustably controlling a shape of each listener-specific audio signal pattern based on the identified positions of the plurality of listeners and adjustably controlling the directivity index associated with each listener-specific audio signal pattern comprises, for each audio signal pattern:

adjustably controlling the directivity index associated with the listener-specific audio signal pattern so that the audio signal pattern comprises:

a maximized intensity of the audio signal pattern in the particular direction towards the particular identified position associated with the particular identified listener, and a minimized intensity of the audio signal pattern in the particular direction towards the listener-specific position associated with the listener.

11. The method of claim 10, wherein adjustably controlling a shape of each listener-specific audio signal pattern comprises:

adjustably controlling audio signals generated by at least two drivers, of the set of drivers, such that the audio signals generated by the at least two drivers adjustably control a shape of at least one audio signal pattern to conform to a particular directivity index associated with the audio signal pattern, via beamforming.

12. The method of claim 11, wherein:

the speaker array comprises at least one set of filter banks, wherein each filter bank comprises a plurality of filters which are each configured to provide a filtered output of at least one channel of the audio content to a separate driver of the set of drivers; and adjustably controlling audio signals generated by the at least two drivers, such that the audio signals generated by the at least two drivers adjustably control a shape of at least one audio signal pattern via beamforming, comprises:

determining a particular filter bank configuration which, when implemented, causes the at least one set of filter banks to provide filtered outputs which, when provided to the set of drivers, causes the at least two drivers to generate audio signals which collectively generate the at least one audio signal pattern via beamforming; and adjustably controlling the at least one set of filter banks to cause the at least one set of filter banks to filter one or more channels of the audio content according to the particular filter bank configuration.

13. The method of claim 12, wherein:

determine the particular filter bank configuration comprises selecting, of a plurality of sets of filter banks comprised in the speaker array, a particular set of filter banks based on a determination that the particular set of filter banks is configured to provide a filtered output of at least one channel of the audio content to at least two drivers of the set of drivers to cause the at least two drivers to generate audio signals which collectively generate the at least one audio signal pattern via beamforming.

14. The method of claim 9, wherein:

the set of drivers are positioned such that each separate driver, of the set of drivers, faces in a different direction; and adjustably controlling a shape of each listener-specific audio signal pattern, based on the identified positions of the plurality of listeners, comprises:

causing an individual driver, of the set of drivers, to generate the audio signal pattern, based on a determination that the individual driver is facing in a particular direction towards the particular identified position associated with the particular identified listener of the plurality of listeners and that the directivity index associated with the audio signal pattern at least meets a particular directivity threshold value.

15. A non-transitory computer readable medium storing a program of instructions which, when executed by at least one computer system, cause the at least one computer system to:

configure a speaker array, which comprises at least one set of filter banks and a set of drivers which generate audio signals based on filtered outputs generated by the at least one set of filter banks, to provide a plurality of listener-specific sound stages of audio content to each of a plurality of listeners, wherein the speaker array further comprises a set of one or more sensor devices which are configured to generate one or more sensor data representations of an environment in which the speaker array is located, wherein the configuring comprises:

identifying a different position associated with each respective listener, of the plurality of listeners, based on processing the one or more sensor data representations; and controllably adjusting a filtering of at least one audio channel of the audio content, by the at least one set of filter banks, to cause the at least one set of filter banks to provide filtered outputs of at least one channel of the audio content to the set of drivers, which causes at least two drivers of the set of drivers to generate audio signals which collectively and at least partially concurrently provide, for each respective listener of the plurality of listeners, a listener-specific audio signal pattern, comprising at least some of the audio content, which is shaped, based on a directivity index associated with the audio signal pattern, to at least partially inhibit an intensity of the audio signal pattern in a direction towards the position associated with another listener of the plurality of listeners.

16. The non-transitory computer readable medium of claim 15, wherein:

the configuring comprises:

controllably adjusting the filtering of at least one audio channel of the audio content, by the at least one set of filter banks, such that each listener-specific audio signal pattern is shaped, based on a directivity index associated with the audio signal pattern and based on the identified positions of the plurality of listeners, to:

provide at least a certain intensity of the audio signal pattern in a particular direction towards a particular identified position associated with a particular identified listener of the plurality of listeners, and at least partially inhibit the intensity of the audio signal pattern in a particular direction towards a listener-specific position associated with a listener of the plurality of listeners.

17. The non-transitory computer readable medium of claim 16, wherein controllably adjusting a filtering of at least one audio channel of the audio content, by the at least one set of filter banks, based on the identified positions of the plurality of listeners comprises, for each audio signal pattern:

controllably adjusting a filtering of at least one audio channel of the audio content, by the at least one set of filter banks, so that the audio signal pattern comprises:

a maximized intensity of the audio signal pattern in the particular direction towards the particular identified position associated with the particular identified listener, and a minimized intensity of the audio signal pattern in the particular direction towards the listener-specific position associated with the listener.

18. The non-transitory computer readable medium of claim 17, wherein, the program of instructions, when executed by at least one computer system, cause the at least one computer system to:

controllably adjust the filtering of at least one audio channel of the audio content, by the at least one set of filter banks, to cause the at least one set of filter banks to provide filtered outputs of at least one channel of the audio content to the set of drivers, which causes at least two drivers of the set of drivers to generate audio signals which collectively provide, for each respective listener of the plurality of listeners, a listener-specific audio signal pattern via beamforming.

19. The non-transitory computer readable medium of claim 18, wherein:

controllably adjusting the filtering of at least one audio channel of the audio content, by the at least one set of filter banks, comprises:

determining a particular filter bank configuration which, when implemented, causes the at least one set of filter banks to provide outputs which, when provided to the set of drivers, causes the at least two drivers to generate audio signals which collectively generate the at least one audio signal pattern via beamforming; and adjustably controlling the at least one set of filter banks to cause the at least one set of filter banks to filter at least one channel of the audio content according to the particular filter bank configuration.

20. The non-transitory computer readable medium of claim 16, wherein:

controllably adjusting the filtering of at least one audio channel of the audio content, by the at least one set of filter banks, based on a directivity index associated with the audio signal pattern and based on the identified positions of the plurality of listeners, comprises:

causing an individual driver, of the set of drivers, to generate the audio signal pattern, based on a determination that the individual driver is facing in a particular direction towards the particular identified position associated with the particular identified listener of the plurality of listeners and that the directivity index associated with the audio signal pattern at least meets a particular directivity threshold value.

* * * * *